US009658543B2

(12) United States Patent
Murakami et al.

(10) Patent No.: US 9,658,543 B2
(45) Date of Patent: May 23, 2017

(54) METHOD FOR PRODUCING ELECTROPHOTOGRAPHIC PHOTOSENSITIVE MEMBER

(71) Applicant: CANON KABUSHIKI KAISHA, Tokyo (JP)

(72) Inventors: Takeshi Murakami, Numazu (JP); Kazumichi Sugiyama, Numazu (JP); Daisuke Kawaguchi, Susono (JP); Daisuke Tanaka, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 13 days.

(21) Appl. No.: 14/793,560

(22) Filed: Jul. 7, 2015

(65) Prior Publication Data

US 2016/0026098 A1 Jan. 28, 2016

(30) Foreign Application Priority Data

Jul. 23, 2014 (JP) ..... 2014-149970

(51) Int. Cl.
*G03G 5/14* (2006.01)
*G03G 5/05* (2006.01)

(52) U.S. Cl.
CPC ..... *G03G 5/0525* (2013.01); *G03G 5/142* (2013.01); *G03G 5/144* (2013.01)

(58) Field of Classification Search
CPC ..... G03G 5/144; G03G 5/142
USPC ..... 430/131, 65, 64, 60, 63
See application file for complete search history.

(56) References Cited

U.S. PATENT DOCUMENTS

| | | | | |
|---|---|---|---|---|
| 8,632,935 | B2 | 1/2014 | Sugiyama et al. | |
| 9,068,083 | B2 | 6/2015 | Tanaka et al. | |
| 9,170,507 | B2 | 10/2015 | Sugiyama et al. | |
| 2006/0009576 | A1* | 1/2006 | Molaire ..... | C08G 18/6212 524/839 |
| 2014/0212807 | A1 | 7/2014 | Miura et al. | |
| 2015/0037716 | A1 | 2/2015 | Maruyama et al. | |
| 2015/0056547 | A1 | 2/2015 | Murakami et al. | |

FOREIGN PATENT DOCUMENTS

| | | | |
|---|---|---|---|
| JP | 2003-91086 | A | 3/2003 |
| JP | 2004-198734 | A | 7/2004 |
| JP | 2006-285077 | A | 10/2006 |
| JP | 2011-138009 | A | 7/2011 |
| WO | WO-2013/081171 | A1 * | 6/2013 |

OTHER PUBLICATIONS

Diamond, A.S., ed., Handbook of Imaging Materials, Marcel Dekker, Inc., NY (1991), pp. 395-396.*
Aldrich Catalog of Handbook of Fine Chemicals, Alrich Company, 1998-1999, pp. 282, 283, 685,746, 1079, and 1569.*

* cited by examiner

*Primary Examiner* — Janis L Dote
(74) *Attorney, Agent, or Firm* — Fitzpatrick Cella Harper and Scinto

(57) ABSTRACT

Provided is a method for producing an electrophotographic photosensitive member including an undercoat layer, the method including preparing a coating liquid for an undercoat layer containing: a titanium oxide particle; a polyol resin; a blocked isocyanate compound in which a structure represented by the formula (1) or the formula (2) is bonded to an isocyanate group; and a monohydric alcohol represented by the formula (3):

(1)

where $R^{11}$ and $R^{12}$ each independently represent an alkyl group having 1 to 4 carbon atoms, and * represents a bonding site capable of being bonded to the isocyanate group;

(2)

where $R^{21}$ and $R^{22}$ each independently represent an alkyl group having 1 to 4 carbon atoms, and * represents a bonding site capable of being bonded to the isocyanate group; and $$HO—R^3 \quad (3)$$

where $R^3$ represents an alkyl group having 1 to 4 carbon atoms.

5 Claims, 2 Drawing Sheets

METHOD FOR PRODUCING ELECTROPHOTOGRAPHIC PHOTOSENSITIVE MEMBER

BACKGROUND OF THE INVENTION

Field of the Invention

The present invention relates to a method for producing an electrophotographic photosensitive member.

Description of the Related Art

An electrophotographic photosensitive member obtained by forming an undercoat layer (intermediate layer) and a photosensitive layer on a support in the stated order is often used as an electrophotographic photosensitive member to be used in an electrophotographic apparatus. The undercoat layer is generally formed by forming a coat of a coating liquid for an undercoat layer containing a binder resin and drying the coat.

The incorporation of metal oxide a particle and the binder resin into the coating liquid for an undercoat layer has been frequently performed for the purposes of concealing a defect of the support and suppressing interference fringes generated by interference between exposure light beams. Further, a titanium oxide particle out of the metal oxide particle is suitable as metal oxide particle to be used in the undercoat layer because the particle has high refractive index and hence exhibits a high scattering effect.

In addition, the binder resin to be used in the undercoat layer is required to have resistance (solvent resistance or insolubility) against a solvent to be incorporated into a coating liquid to be applied above the undercoat layer (such as a coating liquid for a photosensitive layer (a coating liquid for a charge-generating layer or a coating liquid for a charge-transporting layer)). In addition, the undercoat layer is required to have durability against repeated use of the electrophotographic photosensitive member, and such environmental resistance that images can be stably formed under various environments ranging from a high-temperature and high-humidity environment to a low-temperature and low-humidity environment. From such viewpoints, a curable resin is suitable as the binder resin of the undercoat layer. Further, a curable resin capable of being cured at low temperature (production of the curable resin at low temperature) is required from the viewpoint of productivity of the electrophotographic photosensitive member.

With regard to a resin satisfying the foregoing requirements, Japanese Patent Application Laid-Open No. 2004-198734 discloses a technology involving using a curable resin (urethane resin) obtained by causing a blocked isocyanate compound having an isocyanate group blocked with a diethyl malonate structure and a polyol resin to react with each other, as the binder resin of an undercoat layer. The isocyanate group of an isocyanate compound is sometimes blocked with a blocking agent from the viewpoint of controlling its reaction, and the isocyanate compound having a blocked isocyanate group is referred to as "blocked isocyanate compound."

However, as a result of their investigations, the inventors of the present invention have found that such a problem as described below occurs. That is, the inventors have found that a viscosity of a coating liquid containing a blocked isocyanate compound having an isocyanate group blocked with a structure represented by the following formula (1) (alkyl malonate structure) or a structure represented by the following formula (2) (β-ketoester structure), and a polyol resin increases with the lapse of time in some cases.

SUMMARY OF THE INVENTION

As the viscosity of a coating liquid for an undercoat layer increases, the uniformity of a coat of an undercoat layer reduces, and hence the characteristics of the undercoat layer are liable to reduce. Further, the uniformity of, for example, a photosensitive layer (a charge-generating layer or a charge-transporting layer) to be formed on the undercoat layer is affected, and hence an image defect occurs in some cases. In addition, the thickness of the layer is controlled by adjusting the viscosity of the coating liquid, and hence a fluctuation in viscosity of the coating liquid for an undercoat layer needs to be suppressed from the viewpoint of the mass production of electrophotographic photosensitive members having undercoat layers having the same thickness.

In view of the foregoing, the present invention is directed to providing a method for producing an electrophotographic photosensitive member including an undercoat layer using a titanium oxide particle as a metal oxide in which a coating liquid for an undercoat layer that can be cured at low temperature and hardly increases in viscosity with the lapse of time is used.

The inventors of the present invention have made extensive investigations, and as a result, have found that an increase in viscosity of a coating liquid for an undercoat layer can be suppressed by incorporating an isocyanate compound in which a structure represented by the following formula (1) or a structure represented by the following formula (2) is bonded to an isocyanate group, a polyol resin, and a monohydric alcohol represented by the formula (3).

That is, according to one aspect of the present invention, there is provided a method for producing an electrophotographic photosensitive member including a support, an undercoat layer on the support, and a photosensitive layer on the undercoat layer, the method including: preparing a coating liquid for an undercoat layer containing: a titanium oxide particle; a polyol resin; an isocyanate compound in which one of a structure represented by the following formula (1) and a structure represented by the following formula (2) is bonded to an isocyanate group; and a monohydric alcohol represented by the following formula (3); and forming a coat of the coating liquid for an undercoat layer, and drying and curing the coat to form the undercoat layer:

(1)

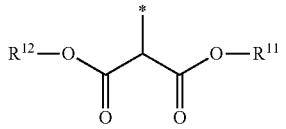

in the formula (1), $R^{11}$ and $R^{12}$ each independently represent an alkyl group having 1 to 4 carbon atoms, and * represents a bonding site capable of being bonded to the isocyanate group;

(2)

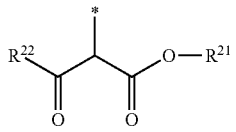

in the formula (2), $R^{21}$ and $R^{22}$ each independently represent an alkyl group having 1 to 4 carbon atoms, and * represents a bonding site capable of being bonded to the isocyanate group; and $$HO—R^3 \quad (3)$$

in the formula (3), $R^3$ represents an alkyl group having 1 to 4 carbon atoms.

According to the aspect of the present invention, it is possible to provide the method for producing an electrophotographic photosensitive member in which a coating liquid for an undercoat layer that can be cured at low temperature and hardly increases in viscosity with the lapse of time is used.

Further features of the present invention will become apparent from the following description of exemplary embodiments with reference to the attached drawings.

DESCRIPTION OF THE EMBODIMENTS

Figure 1A:
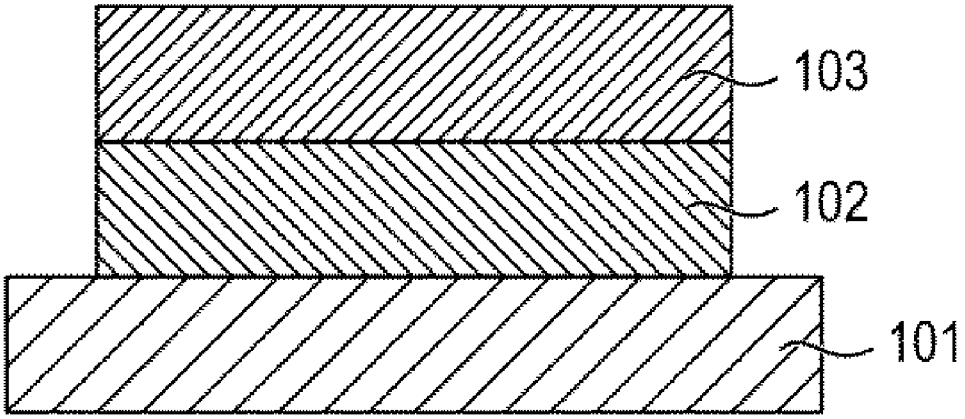
FIGS. 1A and 1B are views for illustrating examples of the layer construction of an electrophotographic photosensitive member produced by a production method of the present invention.

Preferred embodiments of the present invention will now be described in detail in accordance with the accompanying drawings.

A method for producing an electrophotographic photosensitive member of the present invention has a feature in that a coating liquid to be used for the formation of an undercoat layer in the electrophotographic photosensitive member (coating liquid for an undercoat layer) contains: a titanium oxide particle; a polyol resin; an isocyanate compound in which a structure represented by the following formula (1) or a structure represented by the following formula (2) is bonded to an isocyanate group; and a monohydric alcohol represented by the following formula (3).

(1)

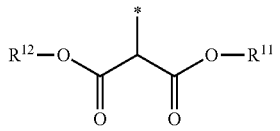

(In the formula (1), $R^{11}$ and $R^{12}$ each independently represent an alkyl group having 1 to 4 carbon atoms, and * represents a bonding site capable of being bonded to the isocyanate group.)

(2)

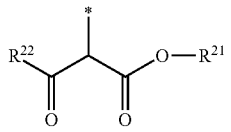

(In the formula (2), $R^{21}$ and $R^{22}$ each independently represent an alkyl group having 1 to 4 carbon atoms, and * represents a bonding site capable of being bonded to the isocyanate group.)

$$HO—R^3 \quad (3)$$

(In the formula (3), $R^3$ represents an alkyl group having 1 to 4 carbon atoms.)

The inventors of the present invention have assumed the reason why the coating liquid for an undercoat layer having the above-mentioned feature can be suppressed from increasing in viscosity with the lapse of time to be as described below.

In the isocyanate compound in which the structure represented by the formula (1) or the structure represented by the formula (2) is bonded to the isocyanate group (hereinafter sometimes referred to as "blocked isocyanate compound having a specific structure"), an alkyl group of the structure represented by the formula (1) or of the structure represented by the formula (2) causes a hydrolysis reaction owing to an influence of moisture in, for example, air to be eliminated. Molecules of the isocyanate compound from which the alkyl group has been eliminated react with each other, or the isocyanate compound undergoes a curing reaction with the polyol resin. In particular, when the titanium oxide particle are used as metal oxide particle in the coating liquid for an undercoat layer, the pH of the coating liquid for an undercoat layer reduces and hence any such reaction is liable to progress. Therefore, the viscosity of the coating liquid for an undercoat layer containing the titanium oxide particle, the blocked isocyanate compound having a specific structure, and the polyol resin is liable to increase with the lapse of time. A problem in that the viscosity increases occurs at the time of, for example, the storage of the coating liquid for an undercoat layer or the formation of a coat of the coating liquid for an undercoat layer.

In the present invention, the coating liquid for an undercoat layer contains the monohydric alcohol represented by the formula (3), i.e., a monohydric alcohol having 1 to 4 carbon atoms. Probably as a result of the foregoing, a reaction between the blocked isocyanate compound having a specific structure and the monohydric alcohol represented by the formula (3) predominantly occurs as compared to a reaction between the blocked isocyanate compound having a specific structure and the polyol resin, and hence the increase in viscosity with the lapse of time can be suppressed.

As described above, the coating liquid for an undercoat layer to be used in the present invention contains the titanium oxide particle, the polyol resin, the isocyanate compound in which the structure represented by the formula (1) or the structure represented by the formula (2) is bonded to the isocyanate group, and the monohydric alcohol represented by the formula (3).

The isocyanate compound in which the structure represented by the formula (1) or the structure represented by the formula (2) is bonded to the isocyanate group (the group is blocked with any such structure) is obtained by, for example, causing an isocyanate compound (isocyanate compound to be blocked) and a compound having the structure represented by the formula (1) or a compound having the structure represented by the formula (2) (blocking agent) to react with each other.

Examples of the isocyanate compound to be blocked include 2,4-tolylene diisocyanate, 2,6-tolylene diisocyanate, diphenylmethane-4,4'-diisocyanate, 1-isocyanato-3,3,5-trimethyl-5-isocyanatomethylcyclohexane (isophorone diisocyanate, IPDI), hexamethylene diisocyanate (HDI), a HDI-trimethylolpropane adduct, a HDI-isocyanurate, and a HDI-biuret. Of those, aliphatic diisocyanates such as hexamethylene diisocyanate and isophorone diisocyanate are preferred from the viewpoints of enhancement of the cross-linking density of a urethane resin and suppression of adsorption of water onto the titanium oxide particle. In addition, a compound whose central skeleton is an isocyanurate is preferred. In addition, only one kind of those isocyanate compounds may be used, or two or more kinds thereof may be used in combination.

Examples of the compound having the structure represented by the formula (1) include dimethyl malonate, diethyl malonate, di(isopropyl) malonate, di(n-propyl) malonate, di(n-butyl) malonate, di(t-butyl) malonate, and t-butylethyl malonate.

Examples of the compound having the structure represented by the formula (2) include methyl acetoacetate, methyl propionylacetate, methyl butyrylacetate, methyl 3-oxoheptanoate, methyl isobutyrylacetate, methyl pivaloylacetate, ethyl acetoacetate, isopropyl acetoacetate, butyl acetoacetate, and propyl acetoacetate.

In addition, examples of the polyol resin include a polyvinyl acetal resin, a polyphenol resin, a polyethylene diol resin, a polycarbonate diol resin, a polyether polyol resin, and a polyacrylic polyol resin. Of those, a polyvinyl acetal resin is preferred. In addition, only one kind of those polyol resins may be used, or two or more kinds thereof may be used in combination.

Examples of the monohydric alcohol represented by the formula (3) include methanol, ethanol, 1-propanol, 1-butanol, and isopropanol.

In addition, the isocyanate compound in which the structure represented by the formula (1) or the structure represented by the formula (2) is bonded to the isocyanate group, and the monohydric alcohol represented by the formula (3) preferably satisfy the following formula (4) or the following formula (5). In other words, the number of carbon atoms of the monohydric alcohol represented by the formula (3) is preferably equal to or less than the number of carbon atoms of $R^{11}$ or $R^{12}$ in the formula (1), or $R^{21}$ in the formula (2). This is because a reaction between the blocked isocyanate compound having a specific structure and the monohydric alcohol represented by the formula (3) more predominantly occurs as compared to a reaction between the compound and the polyol resin, and hence the increase in viscosity due to a change with time can be additionally suppressed.

$$N^{11} \geq N^{12} \geq N^{3} \quad (4)$$

$$N^{21} \geq N^{3} \quad (5)$$

(In the formula (4), $N^{11}$ represents the number of carbon atoms of $R^{11}$ in the formula (1), $N^{12}$ represents the number of carbon atoms of $R^{12}$ in the formula (1), and $N^{3}$ represents the number of carbon atoms of $R^{3}$ in the formula (3). In the formula (5), $N^{21}$ represents the number of carbon atoms of $R^{21}$ in the formula (2) and $N^{3}$ represents the number of carbon atoms of $R^{3}$ in the formula (3).)

The coating liquid for an undercoat layer may contain any other solvent in addition to the monohydric alcohol represented by the formula (3). Examples of the other solvent include a ketone and an ether. The ketone is, for example, methyl ethyl ketone. In addition, examples of the ether include tetrahydropyran, tetrahydrofuran, and 1,3-dioxolane. The mixing ratio (the monohydric alcohol represented by the formula (3)/the other solvent) of the monohydric alcohol represented by the formula (3) to the other solvent, which may be appropriately selected depending on conditions such as an application speed and a drying condition, is, for example, 2/8 or more (mass ratio).

In addition, a solvent having a boiling point higher than that of the monohydric alcohol represented by the formula (3) may be used as the other solvent for the purpose of alleviating a drying rate at the time of the drying of the coat or for the purpose of preventing the occurrence of black spots due to paint dregs. In particular, an ether having a boiling point higher than that of the monohydric alcohol represented by the formula (3) is preferably used. The mixing mass ratio of the monohydric alcohol represented by the formula (3) to the ether having a boiling point higher than that of the monohydric alcohol represented by the formula (3) may be appropriately selected depending on conditions such as an application speed and a drying condition. In particular, the ratio (the monohydric alcohol represented by the formula (3)/the ether having a boiling point higher than that of the monohydric alcohol represented by the formula (3)) is preferably 2/8 or more, more preferably 5/5 or more.

With regard to the ratio at which the monohydric alcohol represented by the formula (3) and the other solvent to be incorporated as required are incorporated into the coating liquid for an undercoat layer, the total amount of the monohydric alcohol represented by the formula (3) and the other solvent is, for example, from 20 mass % to 80 mass %, preferably from 40 mass % to 55 mass %.

The number-average particle diameter of the titanium oxide particles is preferably 0.1 μm or more and 1.0 μm or less from the viewpoint of suppressing interference fringes. Further, titanium oxide particles having a number-average particle diameter of less than 0.1 μm may be used in combination for the purpose of improving the property by which a defect in a support is concealed. The crystal system of titanium oxide is preferably a rutile-type crystal or an anatase-type crystal, more preferably a rutile-type crystal.

Examples of the titanium oxide particles having a number-average particle diameter of from 0.1 μm or more and 1.0 μm or less include: JR, JR-301, JR-403, JR-405, JR-600A, JR-605, JR-600E, JR-603, JR-805, JR-806, JR-701, JRNC, JR-800, JR-1000, JA-1, JA-C, JA-3, and TITANIXJA-1, all of which is manufactured by Tayca Corporation; R-550, R-580, R-630, R-670, R-680, R-780, R-780-2, R-820, R-830, R-850, R-855, R-930, R-980, CR-50, CR-50-2, CR-57, CR-58, CR-58-2, CR-60, CR-60-2, CR-63, CR-67, CR-Super70, CR-80, CR-85, CR-90, CR-90-2, CR-93, CR-95, CR-953, CR-97, CR-EL, PC-3, S-305, PF-690, PF-691, PF-711, PF-736, PF-737, PF-739, PF-740, PF-742, PT-301, PT-501A, PT-501R, UT771, A-100, A-220, W-10, and ST-41, all of which is manufactured by Ishihara Sangyo Kaisha, Ltd.; and SR-1, R-42, R-45M, R-650, R-32, R-5N, GTR-100, R-62N, R-7E, R-3L, R-11P, R-21, R-25, TCR-52, R-310, D-918, FTR-700, R-39, FPT-1, A-110, TCA-123E, A-190, A-197, SA-1, and SA-1L, all of which is manufactured by Sakai Chemical Industry Co., Ltd.

Examples of the titanium oxide particles having a number-average particle diameter of less than 0.1 μm include: MT-01, MT-10EX, MT-05, MT-150A, MT-100S, MT-100TV, MT-100Z, MT-150EX, MT-150W, MT-100AQ, MT-100WP, MT-100SA, MT-100HD, MT-300HD, MT-500HD, MT-500B, MT-500SA, MT-600B, MT-600SA, MT-700B, MT-700HD, MTY-02, MTY-110M3S, MT-500SAS, MTY-700BS, JMT-150IB, JMT-150AO, JMT-150FI, JMT-150ANO, AMT-100, AMT-600, TKP-101, and TKP-102, all of which is manufactured by Tayca Corporation; and TTO-51(A), TTO-51(C), TTO-55(A), TTO-55(B), TTO-55(C), TTO-55(D), TTO-F-2, TTO-F-6, ST-01, ST-21, ST-31, ST-30L, PT-401M, MC-50, MC-90, and MC-150, all of which is manufactured by Ishihara Sangyo Kaisha, Ltd.

The ratio (Mm/Mu) of the mass (Mm) of the titanium oxide particle to be incorporated into the coating liquid for an undercoat layer to the total mass (Mu) of the blocked isocyanate compound having a specific structure and the polyol resin is preferably 1/1 or more (mass ratio). Satisfying the ratio improves an electrical characteristic (by which a fluctuation in light portion potential when the produced electrophotographic photosensitive member is repeatedly used is suppressed). Further, the ratio is more preferably 2/1 or more (mass ratio). Meanwhile, the ratio (Mm/Mu) is preferably 4/1 or less (mass ratio) from the viewpoint of suppressing the occurrence of a crack in the undercoat layer. Therefore, the ratio (Mm/Mu) is preferably 2/1 or more and 4/1 or less (mass ratio).

In addition, an organic resin particle, a leveling agent, and the like may be incorporated into the coating liquid for an undercoat layer from the viewpoint of adjusting the surface roughness of the undercoat layer and from the viewpoint of suppressing the occurrence of a crack in the undercoat layer.

A hydrophobic organic resin particle such as a silicone particle or a hydrophilic organic resin particle such as a crosslinkable polymethacrylate resin (PMMA) particle may be used as the organic resin particle. In particular, the PMMA particle is preferred because the surface roughness of the undercoat layer can be adjusted to fall within a proper range. With regard to a preferred range of the surface roughness of the undercoat layer, the ten-point average roughness (Rzjis) of the undercoat layer is from 0.6 μm to 2.0 μm, and the average interval between the concavity and the protrusion (RSm) of its surface is from 0.010 mm to 0.024 mm. In particular, when the RSm falls within the range, fine-pitch surface roughness occurs. Accordingly, adhesiveness between the undercoat layer and a charge-generating layer or the like to be formed on the layer improves, and hence the fluctuation in potential can be suppressed. It should be noted that the ten-point average roughness and the average interval between the concavity and the protrusion are measured in conformity with the surface roughness standard of JIS B0601-1994 with a surface roughness-measuring machine "SE-3500" (trade name, manufactured by Kosaka Laboratory Ltd.). The ten-point average roughness is the average of values measured at six arbitrary sites of the undercoat layer. In addition, the average interval between the concavity and the protrusion is calculated as follows: ten intervals between the concavity and the protrusion are measured at each of the six arbitrary sites, the average of the measured values is determined, and the average interval between the concavity and the protrusion is calculated as the average of the "respective averages of the six sites." At the time of such measurement, a cutoff value is set to 0.8 mm and an evaluation length is set to 2.5 mm.

In addition, various additives may be incorporated into the coating liquid for an undercoat layer for the purposes of, for example, improving the electrical characteristics of the undercoat layer, improving the shape stability of the film, and improving image quality.

Examples of the additive include a metal particle such as an aluminum particle or a copper particle, conductive particle such as carbon black, a quinone compound, a fluorenone compound, an oxadiazole-based compound, a diphenoquinone compound, an alizarin compound, a benzophenone compound, a polycyclic condensed compound, an azo compound, a metal chelate compound, and a silane coupling agent.

The undercoat layer is obtained by forming the coat of such coating liquid for an undercoat layer, and drying and curing the coat. When the coat of the coating liquid for an undercoat layer is heated, the monohydric alcohol represented by the formula (3) volatilizes (drying), and the isocyanate compound and the polyol resin react with each other (curing) to produce a urethane resin. The temperature (heating temperature) at which the coat of the coating liquid for an undercoat layer is dried and cured is preferably 100° C. or more and 190° C. or less. When the temperature falls within the range, a crack in the undercoat layer is suppressed, and hence the curing reaction between the blocked isocyanate compound having a specific structure and the polyol resin easily progresses. Further, the temperature is more preferably 130° C. or more and 160° C. or less. In addition, the drying time (heating time) of the coat of the coating liquid for an undercoat layer is preferably 10 minutes or more and 120 minutes or less, more preferably 10 minutes or more and 60 minutes or less.

As described above, in the present invention, a coating liquid for an undercoat layer having a specific construction is used, and an increase in viscosity of the coating liquid for an undercoat layer hardly occurs. Therefore, the increase in viscosity at the time of, for example, the storage of the coating liquid for an undercoat layer or the formation of a coat of the coating liquid for an undercoat layer is suppressed, and hence an undercoat layer to be formed can be uniformized. In addition, the coating liquid for an undercoat layer to be used in the present invention is excellent in productivity because the coating liquid can be cured at low temperature.

An electrophotographic photosensitive member produced by the production method of the present invention (hereinafter sometimes referred to as "electrophotographic photosensitive member of the present invention") is an electrophotographic photosensitive member including a support, an undercoat layer on the support, and a photosensitive layer on the undercoat layer. The electrophotographic photosensitive member is preferably an electrophotographic photosensitive member including, as the photosensitive layer, a laminated photosensitive layer having a charge-generating layer arranged on the undercoat layer and a charge-transporting layer arranged on the charge-generating layer.

Figure 1B:
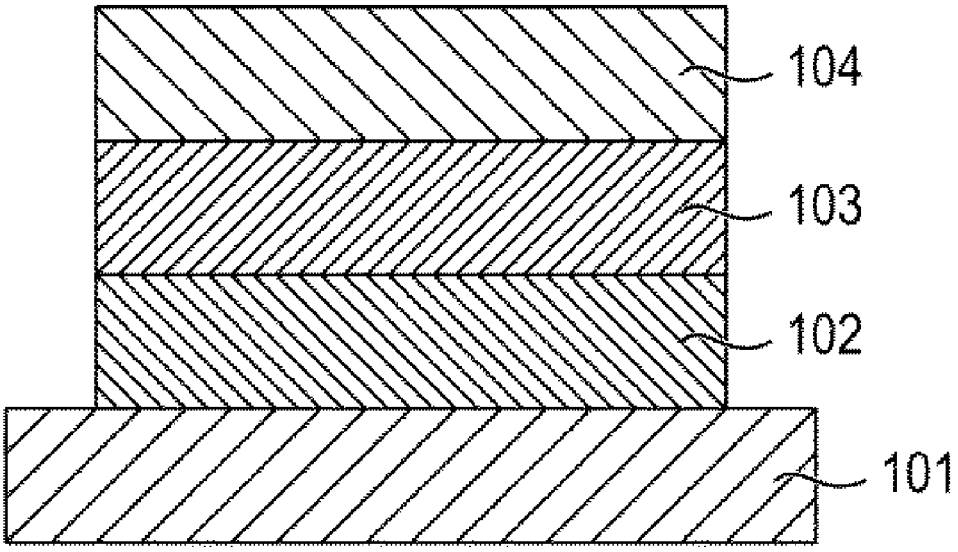

Examples of the layer construction of the electrophotographic photosensitive member produced by the production method of the present invention are illustrated in FIG. 1A and FIG. 1B. In FIG. 1A and FIG. 1B, a support is represented by reference numeral 101, an undercoat layer is represented by reference numeral 102, and a photosensitive layer is represented by reference numeral 103.

The photosensitive layer is preferably a laminated photosensitive layer obtained by laminating a charge-generating layer containing a charge-generating substance and a charge-transporting layer containing a charge-transporting substance in the stated order from an undercoat layer side. In addition, the charge-transporting substance to be incorporated into the charge-transporting layer is preferably a hole-transporting substance.

The support is preferably a support having conductivity (conductive support). Examples thereof include supports made of metals (or made of alloys) such as aluminum, an aluminum alloy, stainless steel, copper, nickel, and zinc. In addition, when a support made of aluminum or a support made of an aluminum alloy is used, an ED tube, an EI tube, or the like may be used.

In addition, a product obtained by forming a thin film of a conductive material such as aluminum, an aluminum alloy, or an indium oxide-tin oxide alloy on a support made of a metal or a support made of a resin may also be used as the support.

In addition, the surface of the support may be subjected to cutting treatment, roughening treatment, alumite treatment, electrolytic composite polishing treatment, wet honing treatment, dry honing treatment, or the like for the purpose of, for example, suppressing interference fringes due to the scattering of laser light. The electrolytic composite polishing involves: electrolysis with an electrode having an electrolytic action and an electrolytic solution; and polishing with a grindstone having a polishing action.

An electro-conductive layer may be formed between the support and the undercoat layer for the purposes of, for example, suppressing the interference fringes due to the scattering of the laser light and concealing (covering) a flaw in the support.

The electro-conductive layer may be formed by: applying a coating liquid for an electro-conductive layer, which is obtained by subjecting carbon black, a conductive particle such as a metal particle and a metal oxide particle, a binder resin, and a solvent to dispersion treatment, to form a coat; and drying and/or curing the resultant coat.

Examples of the binder resin to be used for the electro-conductive layer include a polyester resin, a polycarbonate resin, a polyvinyl acetal resin, an acrylic resin, a silicone resin, an epoxy resin, a melamine resin, a urethane resin, a phenol resin, and an alkyd resin.

Examples of the solvent of the coating liquid for an electro-conductive layer include an ether-based solvent, an alcohol-based solvent, a ketone-based solvent, and an aromatic hydrocarbon-based solvent. In addition, only one kind of those solvents may be used, or two or more kinds thereof may be used in combination.

The thickness of the electro-conductive layer is preferably 5 μm or more and 40 μm or less, more preferably 10 μm or more and 30 μm or less.

In the present invention, as described above, the undercoat layer is formed by using the coating liquid for an undercoat layer prepared by using the titanium oxide particle, the polyol resin, the blocked isocyanate compound having a specific structure, and the monohydric alcohol represented by the formula (3).

The coating liquid for an undercoat layer may be prepared by, for example, subjecting the titanium oxide particle, the polyol resin, the blocked isocyanate compound having a specific structure, and the monohydric alcohol represented by the formula (3) to dispersion treatment.

A method of the dispersion treatment is, for example, a method involving using a dispersion treatment apparatus such as a paint shaker, a ball mill, a sand mill, or a roll mill. As a dispersive medium to be used in such dispersion treatment apparatus, there are given spherical glass beads, alumina beads, zirconia beads, and the like. In addition, the particle diameters (diameters) of those beads are preferably 0.3 mm or more and 1.0 mm or less.

The thickness of the undercoat layer is preferably 0.5 μm or more and 40 μm or less from the viewpoint of suppressing a fluctuation in light portion potential due to repeated use of the electrophotographic photosensitive member, and is more preferably 0.5 μm or more and 10 μm or less.

In addition, when the electro-conductive layer is not formed, the thickness of the undercoat layer is preferably 10 μm or more and 40 μm or less from the viewpoint of concealing (covering) a flaw in the support, and is more preferably 15 μm or more and 35 μm or less.

The photosensitive layer (the charge-generating layer and the charge-transporting layer) is formed on the undercoat layer.

When the photosensitive layer is a laminated photosensitive layer, the charge-generating layer may be formed by: applying a coating liquid for a charge-generating layer, which is obtained by subjecting the charge-generating substance, a binder resin, and a solvent to dispersion treatment; and drying the resultant coat. In addition, the charge-generating layer may be a deposited film of the charge-generating substance.

A method of the dispersion treatment is, for example, a method involving using a homogenizer, an ultrasonic dispersing machine, a ball mill, a sand mill, a roll mill, a vibration mill, an attritor, or a liquid collision-type high-speed dispersing machine.

Examples of the charge-generating substance include an azo pigment, a phthalocyanine pigment, an indigo pigment, a perylene pigment, a polycyclic quinone pigment, a squarylium dye, a thiapyrylium salt, a triphenylmethane dye, a quinacridone pigment, an azulenium salt pigment, a cyanine dyestuff, an anthanthrone pigment, a pyranthrone pigment, a xanthene dye, a quinoneimine dye, and a styryl dye. Of those, an oxytitanium phthalocyanine, a chlorogallium phthalocyanine, or a hydroxygallium phthalocyanine is preferred from the viewpoint of sensitivity, and of those, a hydroxygallium phthalocyanine is more preferred. In addition, out of the hydroxygallium phthalocyanines, a hydroxygallium phthalocyanine crystal of a crystal form having peaks at Bragg angles 2θ in CuKα characteristic X-ray diffraction of 7.4°±0.3° and 28.2°±0.3° is preferred. In addition, only one kind of those charge-generating substances may be used, or two or more kinds thereof may be used in combination.

Examples of the binder resin to be used for the charge-generating layer in the case where the photosensitive layer is a laminated photosensitive layer include a polycarbonate resin, a polyester resin, a polyvinyl acetal resin, an acrylic resin, a vinyl acetate resin, and a urea resin. Of those, a polyvinyl acetal resin is preferred. In addition, only one kind of those binder resins may be used, or two or more kinds thereof may be used in combination as a mixture or a copolymer.

Examples of the solvent to be used for the coating liquid for a charge-generating layer include an alcohol-based solvent, a sulfoxide-based solvent, a ketone-based solvent, an ether-based solvent, an ester-based solvent, and an aromatic hydrocarbon-based solvent. In addition, only one kind of those solvents may be used, or two or more kinds thereof may be used in combination.

The thickness of the charge-generating layer is preferably 0.01 μm or more and 5 μm or less, more preferably 0.1 μm or more and 2 μm or less.

In addition, various sensitizers, antioxidants, UV absorbers, plasticizers, and the like may each be incorporated into the charge-generating layer as required.

In the electrophotographic photosensitive member including the laminated photosensitive layer, the charge-transporting layer is formed on the charge-generating layer.

The charge-transporting layer may be formed by: applying a coating liquid for a charge-transporting layer obtained by dissolving the charge-transporting substance and a binder resin in a solvent; and drying the resultant coat.

The charge-transporting substance is broadly classified into a hole-transporting substance and an electron-transporting substance. Examples of the hole-transporting substance include a triarylamine compound, a hydrazone compound, a styryl compound, a stilbene compound, and a butadiene compound. Of those, a triarylamine compound is preferred. In addition, only one kind of those charge-transporting substances may be used, or two or more kinds thereof may be used in combination.

Examples of the binder resin to be used for the charge-transporting layer in the case where the photosensitive layer is a laminated photosensitive layer include an acrylic resin, an acrylonitrile resin, an allyl resin, an alkyd resin, an epoxy resin, a silicone resin, a phenol resin, a phenoxy resin, a polyacrylamide resin, a polyamide imide resin, a polyamide resin, a polyallyl ether resin, a polyarylate resin, a polyimide resin, a urethane resin, a polyester resin, a polyethylene resin, a polycarbonate resin, a polysulfone resin, a polyphenylene oxide resin, a polybutadiene resin, a polypropylene resin, and a methacrylic resin. Of those, a polyarylate resin or a polycarbonate resin is preferred. In addition, only one kind of those binder resins may be used, or two or more kinds thereof may be used in combination as a mixture or a copolymer.

Examples of the solvent to be used for the coating liquid for a charge-transporting layer include an alcohol-based solvent, a sulfoxide-based solvent, a ketone-based solvent, an ether-based solvent, an ester-based solvent, and an aromatic hydrocarbon-based solvent. In addition, only one kind of those solvents may be used, or two or more kinds thereof may be used in combination.

A ratio (charge-transporting substance/binder resin) between the charge-transporting substance and binder resin to be incorporated into the charge-transporting layer is preferably 0.3/1 or more and 10/1 or less (mass ratio).

The temperature at which the coat of the coating liquid for a charge-transporting layer is heated (drying temperature) is preferably 60° C. or more and 150° C. or less from the viewpoint of suppressing a crack in the charge-transporting layer, and is more preferably 80° C. or more and 120° C. or less. In addition, the time period for which the coat is heated (drying time) is preferably 10 minutes or more and 60 minutes or less.

When the number of the charge-transporting layers in the electrophotographic photosensitive member is one, the thickness of the charge-transporting layer is preferably 5 μm or more and 40 μm or less, more preferably 8 μm or more and 30 μm or less.

When the charge-transporting layer is of a laminated construction, the thickness of the charge-transporting layer on a support side is preferably 5 μm or more and 30 μm or less, and the thickness of the charge-transporting layer on a surface side is preferably 1 μm or more and 10 μm or less.

In addition, an antioxidant, a UV absorber, a plasticizer, or the like may be incorporated into the charge-transporting layer as required.

In addition, in the present invention, as illustrated in FIG. 1B, a protective layer 104 may be formed on the photosensitive layer (charge-transporting layer) for the purpose of, for example, improving the durability and cleaning property of the electrophotographic photosensitive member.

The protective layer may be formed by: applying a coating liquid for a protective layer obtained by dissolving a resin (or a monomer and/or oligomer thereof) in a solvent; and drying and/or curing the resultant coat.

Examples of the resin to be used for the protective layer include a polyvinyl acetal resin, a polyester resin, a polycarbonate resin, a polyamide resin, a polyimide resin, a polyarylate resin, a urethane resin, an acrylic resin, a methacrylic resin, a styrene-butadiene copolymer, a styrene-acrylic acid copolymer, and a styrene-acrylonitrile copolymer. Of those, an acrylic resin or a methacrylic resin is preferred. In addition, only one kind of those resins may be used, or two or more kinds thereof may be used in combination.

In addition, in order to impart a charge-transporting ability to the protective layer, the protective layer (second charge-transporting layer) may be formed by curing a monomer having a charge-transporting ability (hole-transporting ability) by means of various polymerization reactions or crosslinking reactions. Specifically, the protective layer (second charge-transporting layer) is preferably formed by polymerizing or crosslinking a charge-transportable compound (hole-transportable compound) having a chain polymerizable functional group to cure the compound.

Examples of the chain polymerizable functional group include an acryloyloxy group, a methacryloyloxy group, an alkoxysilyl group, and an epoxy group. A reaction for the curing is, for example, a radical polymerization reaction or an ionic polymerization reaction. In addition, heat, light such as UV light, a radiation such as an electron beam, or the like may be used at the time of the curing reaction.

Further, a conductive particle, a UV absorber, a wear resistance improver, or the like may be incorporated into the protective layer as required. Examples of the conductive particle include a metal oxide particle such as a tin oxide particle. Examples of the wear resistance improver include a fluorine atom-containing resin particle such as a polytetrafluoroethylene particle, alumina, and silica.

The thickness of the protective layer is preferably 0.5 μm or more and 20 μm or less, more preferably 1 μm or more and 10 μm or less.

In the application of the coating liquid for each layer, there may be used, for example, an application method such as a dip coating method, a spray coating method, a spinner coating method, a roller coating method, a Mayer bar coating method, or a blade coating method.

Figure 2:
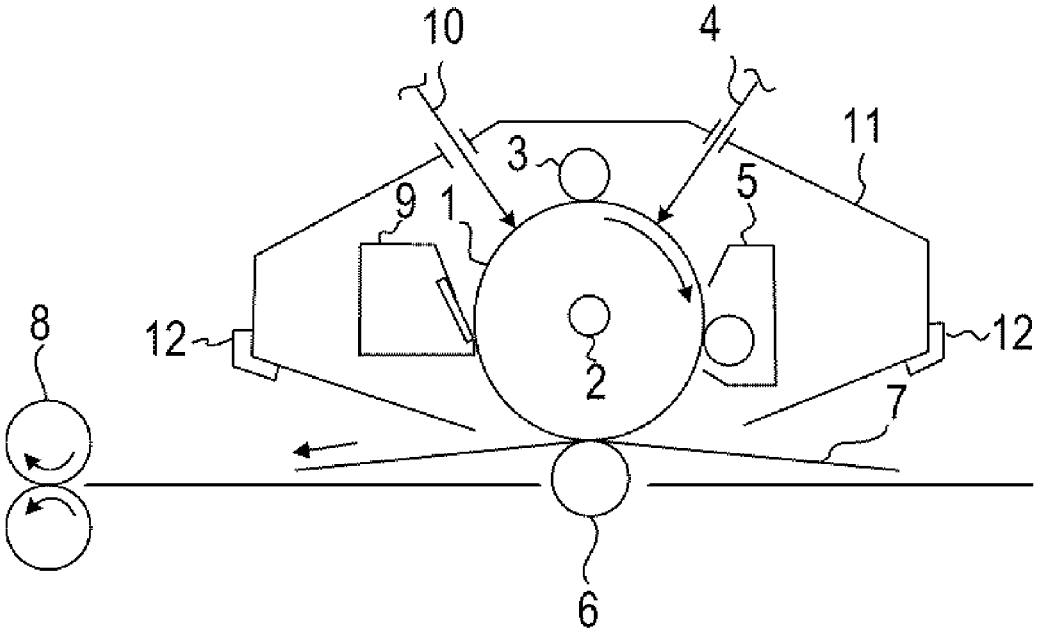
FIG. 2 is a view for illustrating an example of the schematic construction of an electrophotographic apparatus including a process cartridge having an electrophotographic photosensitive member produced by the production method of the present invention.

The schematic construction of an electrophotographic apparatus including a process cartridge including the electrophotographic photosensitive member produced by the production method of the present invention is illustrated in FIG. 2.

In FIG. 2, a cylindrical (drum-shaped) electrophotographic photosensitive member 1 is rotationally driven about an axis 2 in a direction indicated by the arrow at a predetermined peripheral speed (process speed).

The surface (peripheral surface) of the electrophotographic photosensitive member 1 is charged to a predetermined positive or negative potential by a charging unit 3 (primary charging unit: a charging roller or the like) in a rotation process.

Next, the surface of the electrophotographic photosensitive member 1 is irradiated with exposure light (image exposure light) 4 from an exposing unit (image-exposing unit) (not shown).

Thus, an electrostatic latent image is formed on the surface of the electrophotographic photosensitive member 1.

Next, the electrostatic latent image formed on the surface of the electrophotographic photosensitive member 1 is developed (normal development or reversal development) with a developer (toner) in a developing unit 5, whereby a toner image is formed on the surface of the electrophotographic photosensitive member 1.

Next, the toner image formed on the surface of the electrophotographic photosensitive member 1 is transferred onto a transfer material 7 by a transferring unit 6 (such as a transfer roller).

Here, the transfer material 7 is taken out of a transfer material-supplying unit (not shown) in synchronization with the rotation of the electrophotographic photosensitive member 1, and is supplied to a space (abutment portion) between the electrophotographic photosensitive member 1 and the transferring unit 6.

In addition, a voltage (transfer bias) opposite in polarity to the charge of the toner is applied from a bias power source (not shown) to the transferring unit 6.

The transfer material 7 onto which the toner image has been transferred is separated from the surface of the electrophotographic photosensitive member 1 and conveyed to a fixing unit 8, where the toner image is subjected to fixing treatment. Thus, the transfer material is printed out as an image-formed product (print or copy) to the outside of the electrophotographic apparatus.

The transferring unit 6 may be a transferring unit of an intermediate transfer system including, for example, a primary transfer member, an intermediate transfer member, and a secondary transfer member.

The surface of the electrophotographic photosensitive member 1 after the transfer of the toner image onto the transfer material 7 is cleaned by a cleaning unit 9 (such as a cleaning blade), whereby an adhering substance such as a transfer residual developer (transfer residual toner) is removed.

In addition, the transfer residual toner may be recovered by the developing unit or the like (cleaner-less system).

Further, the surface of the electrophotographic photosensitive member 1 is subjected to antistatic treatment by being irradiated with pre-exposure light 10 from a pre-exposing unit (not shown). After that, the surface is repeatedly used in image formation.

It should be noted that when the charging unit 3 is a contact charging unit using a charging roller or the like as illustrated in FIG. 2, pre-exposure is not necessarily needed.

In the present invention, the following procedure may be adopted: a plurality of constituents selected from, for example, the electrophotographic photosensitive member 1, the charging unit 3, the developing unit 5, and the cleaning unit 9 are stored in a container and integrally bonded to constitute a process cartridge.

In addition, the process cartridge may be detachably mountable to the main body of the electrophotographic apparatus. For example, the electrophotographic photosensitive member 1, and at least one unit selected from the charging unit 3, the developing unit 5, the transferring unit 6, and the cleaning unit 9 are integrally supported to provide a cartridge. In addition, the cartridge can serve as a process cartridge 11 detachably mountable to the main body of the electrophotographic apparatus by using a guiding unit 12 such as a rail of the main body of the electrophotographic apparatus.

Examples of the exposure light 4 include: reflected light or transmitted light from an original; and light to be applied by, for example, scanning with a laser beam, the driving of a LED array, or the driving of a liquid crystal shutter array to be performed according to a signal obtained by signalizing the original read with a sensor.

EXAMPLES

The invention of the present application is hereinafter described in more detail by way of Examples, which by no means limit the invention of the present application. It should be noted that the term "part(s)" in Examples means "part(s) by mass."

Example 1

A coating liquid for an undercoat layer was prepared by mixing the following materials, dispersing the mixture with a sand mill apparatus by using glass beads each having a diameter of 0.8 mm for 4 hours, and adding 0.01 part of silicone oil (trade name: SH 28 PA, manufactured by Dow Corning Toray Silicone Co., Ltd.) and 5.6 parts of polymethyl methacrylate resin particles (trade name: SSX-103, manufactured by Sekisui Plastics Co., Ltd.) after the dispersion.

Titanium oxide particles (trade name: CR-EL, manufactured by Ishihara Sangyo Kaisha, Ltd.) 81 parts Blocked isocyanate (reaction product of hexamethylene diisocyanate (isocyanate compound to be blocked) and diethyl malonate (blocking agent)) 15 parts Polyvinyl acetal resin (trade name: BM-1, manufactured by Sekisui Chemical Co., Ltd.) 15 parts Mixed solution of 70.0 parts of methyl ethyl ketone and 30.0 parts of ethanol 100 parts The prepared coating liquid for an undercoat layer was rotationally stirred in a roll frame rotating once per second for 1 day. After that, the coating liquid was applied onto an aluminum element tube (ED tube) (manufactured by Showa Denko K.K., measuring 24 mm in diameter by 357.5 mm in length, Rzjis=0.8 μm) by dip coating, and was heated at 150° C. for 20 minutes to form an undercoat layer having a thickness of 30 μm.

Next, 10 parts of a hydroxygallium phthalocyanine, 0.1 part of a compound represented by the following formula (C), and 5 parts of a polyvinyl acetal resin (trade name: S-LEC BX-1, manufactured by Sekisui Chemical Co., Ltd.) were added to 250 parts of cyclohexanone, and the mixture was dispersed with a sand mill apparatus using glass beads each having a diameter of 0.8 mm for 3 hours. Thus, a dispersion liquid of a hydroxygallium phthalocyanine of a crystal form having strong peaks at positions corresponding to Bragg angles)($2\theta \pm 0.2°$ in CuKα characteristic X-ray diffraction of 7.5°, 9.9°, 16.3°, 18.6°, 25.1°, and 28.3° was obtained. 100 Parts of cyclohexanone and 450 parts of ethyl acetate were further added to the dispersion liquid to dilute the dispersion liquid. Thus, a coating liquid for a charge-generating layer was obtained. The resultant coating liquid was applied onto the undercoat layer by dip coating, and was dried at 100° C. for 10 minutes to form a charge-generating layer having a thickness of 0.17 μm.

(C)

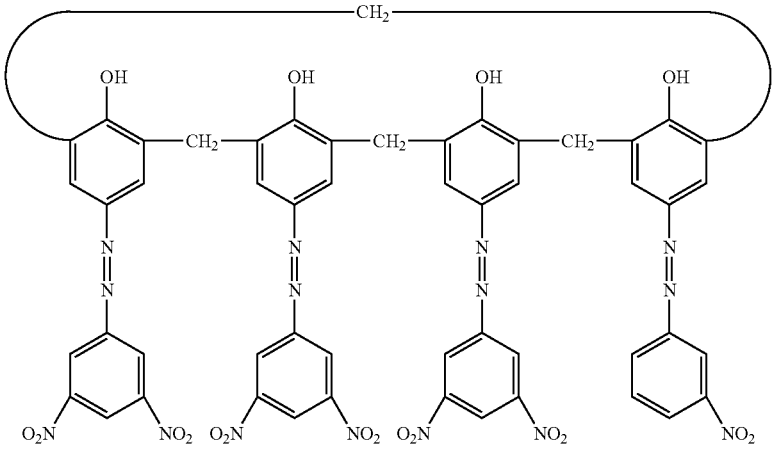

Next, 50 parts of a compound represented by the following formula (D) and 50 parts of a compound represented by the following formula (E) as charge-transporting substances, and 100 parts of a polycarbonate resin (trade name: Iupilon Z400, manufactured by Mitsubishi Gas Chemical Company, Inc.) were dissolved in a mixed solvent of 650 parts of monochlorobenzene and 150 parts of methylal to prepare a coating liquid for a charge-transporting layer. The coating liquid for a charge-transporting layer was applied onto the charge-generating layer by dip coating, and was dried at 120° C. for 30 minutes to form a charge-transporting layer having a thickness of 23 μm.

(D)

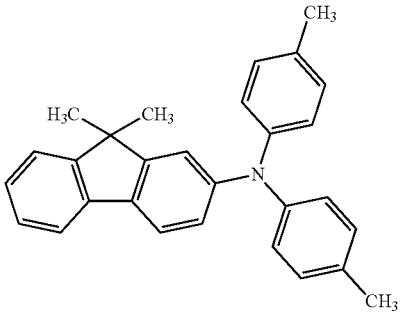

(E)

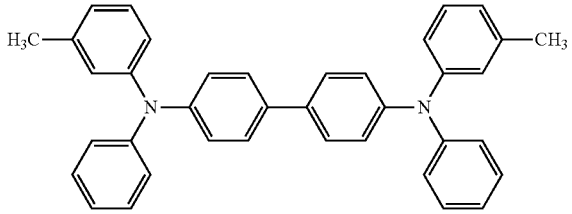

In addition, the number-average particle diameter of the titanium oxide particles in the coating liquid for an undercoat layer that had been rotationally stirred in the roll frame rotating once per second for 1 day after the preparation was measured to be 338 nm. In addition, the viscosity of the coating liquid for an undercoat layer was measured to be 250 mPa·s.

In addition, the prepared coating liquid for an undercoat layer was loaded into a cylindrical container, and was rotationally stirred in a roll frame rotating once per second for 1 month after the preparation. After that, the number-average particle diameter of the titanium oxide particles in the coating liquid for an undercoat layer was measured to be 346 nm. In addition, the viscosity of the coating liquid for an undercoat layer was measured to be 263 mPa·s.

It should be noted that the number-average particle diameter of the titanium oxide particles in the coating liquid for an undercoat layer was measured as follows: the coating liquid for an undercoat layer was diluted with a mixed solvent containing methyl ethyl ketone (MEK) and ethanol at a mass ratio of 7:3, and the diluted liquid was subjected to the measurement with a particle diameter-measuring apparatus manufactured by Sysmex (trade name: ZETASIZER NANO). In addition, the viscosity of the coating liquid for an undercoat layer was measured with a B-type viscometer manufactured by Shibaura System Co., Ltd. (trade name: Vismetron Model VS-A1, single cylindrical rotational viscometer) under the conditions of a measurement temperature of 23° C. and a number of revolutions of 60 rpm.

Examples 2 to 20

Electrophotographic photosensitive members were each produced in the same manner as in Example 1 except that in Example 1, the kind of the metal oxide particles used in the preparation of the coating liquid for an undercoat layer (JR (manufactured by Tayca Corporation), CR-85 (manufactured by Ishihara Sangyo Kaisha, Ltd.), PF-711 (manufactured by Ishihara Sangyo Kaisha, Ltd.), R-5N (manufactured by Sakai Chemical Industry Co., Ltd.), or A-197 (manufactured by Sakai Chemical Industry Co., Ltd.)), the kind of the blocked isocyanate used in the preparation, the kind of the polyol resin used in the preparation, the kind of the mixed solvent used in the preparation, and the diluent solvent at the time of the measurement of the number-average particle diameter were changed as shown in Table 1. In addition, the number-average particle diameters of titanium oxide in each coating liquid for an undercoat layer, and the viscosities of the coating liquid for an undercoat layer, 1 day and 1 month after its preparation were measured in the same manner as in Example 1. The results are shown in Table 3.

Comparative Examples 1 and 2

Electrophotographic photosensitive members were each produced in the same manner as in Example 1 except that in Example 1, the kind of the metal oxide particles used in the preparation of the coating liquid for an undercoat layer, the kind of the blocked isocyanate used in the preparation, the kind of the polyol resin used in the preparation, the kind of the mixed solvent used in the preparation, and the diluent solvent at the time of the measurement of the number-average particle diameter were changed as shown in Table 2.

In addition, the number-average particle diameters of titanium oxide in each coating liquid for an undercoat layer, and the viscosities of the coating liquid for an undercoat layer, 1 day and 1 month after its preparation were measured in the same manner as in Example 1. The results are shown in Table 4.

TABLE 1

| | Metal oxide particles | | Blocked isocyanate | | | Polyol resin | |
|---|---|---|---|---|---|---|---|
| Example Number | Titanium oxide particles | Content (parts) | Isocyanate compound to be blocked | Blocking agent | Content (parts) | Kind | Content (parts) |
| Example 1 | CR-EL | 81 | Hexamethylene diisocyanate | Diethyl malonate | 15 | BM-1 | 15 |
| Example 2 | JR | 81 | Hexamethylene diisocyanate | Diethyl malonate | 15 | BM-1 | 15 |
| Example 3 | CR-85 | 81 | Hexamethylene diisocyanate | Diethyl malonate | 15 | BM-1 | 15 |
| Example 4 | PF-711 | 81 | Hexamethylene diisocyanate | Diethyl malonate | 15 | BM-1 | 15 |
| Example 5 | R-5N | 81 | Hexamethylene diisocyanate | Diethyl malonate | 15 | BM-1 | 15 |
| Example 6 | A-197 | 81 | Hexamethylene diisocyanate | Diethyl malonate | 15 | BM-1 | 15 |
| Example 7 | JR | 81 | Hexamethylene diisocyanate | Dibutyl malonate | 15 | BM-1 | 15 |
| Example 8 | JR | 81 | Hexamethylene diisocyanate | Dibutyl malonate | 15 | BM-1 | 15 |
| Example 9 | JR | 81 | Hexamethylene diisocyanate | Dibutyl malonate | 15 | BM-1 | 15 |
| Example 10 | JR | 81 | Hexamethylene diisocyanate | Dibutyl malonate | 15 | BM-1 | 15 |
| Example 11 | JR | 81 | Hexamethylene diisocyanate | Dimethyl malonate | 15 | BM-1 | 15 |
| Example 12 | JR | 81 | Hexamethylene diisocyanate | Butyl pivaloyl acetate | 15 | BM-1 | 15 |
| Example 13 | JR | 81 | Hexamethylene diisocyanate | Butyl pivaloyl acetate | 15 | BM-1 | 15 |
| Example 14 | JR | 81 | Hexamethylene diisocyanate | Butyl pivaloyl acetate | 15 | BM-1 | 15 |
| Example 15 | JR | 81 | Hexamethylene diisocyanate | Butyl pivaloyl acetate | 15 | BM-1 | 15 |
| Example 16 | JR | 81 | Hexamethylene diisocyanate | Diethyl malonate | 15 | BM-1 | 15 |
| Example 17 | JR | 81 | Hexamethylene diisocyanate | Diethyl malonate | 15 | BM-1 | 15 |
| Example 18 | JR | 81 | Hexamethylene diisocyanate | Diethyl malonate | 15 | BM-1 | 15 |
| Example 19 | JR | 81 | Hexamethylene diisocyanate | Butyl pivaloyl acetate | 15 | BM-1 | 15 |
| Example 20 | JR | 81 | Hexamethylene diisocyanate | Dipropyl malonate | 15 | BM-1 | 15 |

| | Mixed solvent | | | | Diluent solvent in measurement of number-average particle diameter | | |
|---|---|---|---|---|---|---|---|
| Example Number | Solvent 1 | Solvent 2 | Ratio | Content (parts) | Solvent 1 | Solvent 2 | Ratio |
| Example 1 | Methyl ethyl ketone | Ethanol | 7:3 | 100 | Methyl ethyl ketone | Ethanol | 7:3 |
| Example 2 | Methyl ethyl ketone | Ethanol | 7:3 | 100 | Methyl ethyl ketone | Ethanol | 7:3 |
| Example 3 | Methyl ethyl ketone | Ethanol | 7:3 | 100 | Methyl ethyl ketone | Ethanol | 7:3 |

TABLE 1-continued

| | | | | | | | |
|---|---|---|---|---|---|---|---|
| Example 4 | Methyl ethyl ketone | Ethanol | 7:3 | 100 | Methyl ethyl ketone | Ethanol | 7:3 |
| Example 5 | Methyl ethyl ketone | Ethanol | 7:3 | 100 | Methyl ethyl ketone | Ethanol | 7:3 |
| Example 6 | Methyl ethyl ketone | Ethanol | 7:3 | 100 | Methyl ethyl ketone | Ethanol | 7:3 |
| Example 7 | Methyl ethyl ketone | 1-Butanol | 7:3 | 100 | Methyl ethyl ketone | 1-Butanol | 7:3 |
| Example 8 | Methyl ethyl ketone | 1-Propanol | 7:3 | 100 | Methyl ethyl ketone | 1-Propanol | 7:3 |
| Example 9 | Methyl ethyl ketone | Ethanol | 7:3 | 100 | Methyl ethyl ketone | Ethanol | 7:3 |
| Example 10 | Methyl ethyl ketone | Methanol | 7:3 | 100 | Methyl ethyl ketone | Methanol | 7:3 |
| Example 11 | Methyl ethyl ketone | Methanol | 7:3 | 100 | Methyl ethyl ketone | Methanol | 7:3 |
| Example 12 | Methyl ethyl ketone | 1-Butanol | 7:3 | 100 | Methyl ethyl ketone | 1-Butanol | 7:3 |
| Example 13 | Methyl ethyl ketone | 1-Propanol | 7:3 | 100 | Methyl ethyl ketone | 1-Propanol | 7:3 |
| Example 14 | Methyl ethyl ketone | Ethanol | 7:3 | 100 | Methyl ethyl ketone | Ethanol | 7:3 |
| Example 15 | Methyl ethyl ketone | Methanol | 7:3 | 100 | Methyl ethyl ketone | Methanol | 7:3 |
| Example 16 | Tetrahydro-pyran | Methanol | 7:3 | 100 | Tetrahydro-pyran | Methanol | 7:3 |
| Example 17 | Tetrahydro-furan | Methanol | 7:3 | 100 | Tetrahydro-furan | Methanol | 7:3 |
| Example 18 | 1,3-Dioxolane | Methanol | 7:3 | 100 | 1,3-Dioxolane | Methanol | 7:3 |
| Example 19 | Tetrahydro-furan | Methanol | 7:3 | 100 | Tetrahydro-furan | Methanol | 7:3 |
| Example 20 | Methyl ethyl ketone | 1-Butanol | 7:3 | 100 | Methyl ethyl ketone | 1-Butanol | 7:3 |

TABLE 2

| Comparative Example Number | Metal oxide particles: Titanium oxide particles | Metal oxide particles: Content (parts) | Blocked isocyanate: Isocyanate compound to be blocked | Blocked isocyanate: Blocking agent | Blocked isocyanate: Content (parts) | Polyol resin: Kind | Polyol resin: Content (parts) |
|---|---|---|---|---|---|---|---|
| Comparative Example 1 | JR | 81 | Hexamethylene diisocyanate | Dipropyl malonate | 15 | BM-1 | 15 |
| Comparative Example 2 | JR | 81 | Hexamethylene diisocyanate | Dipropyl malonate | 15 | BM-1 | 15 |

| Comparative Example Number | Mixed solvent: Solvent 1 | Mixed solvent: Solvent 2 | Mixed solvent: Ratio | Mixed solvent: Content (parts) | Diluent solvent in measurement of number-average particle diameter: Solvent 1 | Diluent solvent in measurement of number-average particle diameter: Solvent 2 | Diluent solvent in measurement of number-average particle diameter: Ratio |
|---|---|---|---|---|---|---|---|
| Comparative Example 1 | Methyl ethyl ketone | 1-Pentanol | 7:3 | 100 | Methyl ethyl ketone | 1-Pentanol | 7:3 |
| Comparative Example 2 | Methyl ethyl ketone | — | 10:0 | 100 | Methyl ethyl ketone | — | 10:0 |

TABLE 3

| Example Number | 1 Day after preparation Viscosity | 1 Day after preparation Number-average particle diameter | 1 Month after preparation Viscosity | 1 Month after preparation Number-average particle diameter |
|---|---|---|---|---|
| Example 1 | 250 mPa · s | 338 nm | 263 mPa · s | 346 nm |
| Example 2 | 243 mPa · s | 290 nm | 257 mPa · s | 298 nm |
| Example 3 | 255 mPa · s | 352 nm | 271 mPa · s | 360 nm |
| Example 4 | 253 mPa · s | 336 nm | 266 mPa · s | 348 nm |
| Example 5 | 240 mPa · s | 341 nm | 253 mPa · s | 352 nm |
| Example 6 | 242 mPa · s | 253 nm | 257 mPa · s | 263 nm |
| Example 7 | 251 mPa · s | 288 nm | 266 mPa · s | 299 nm |
| Example 8 | 257 mPa · s | 292 nm | 267 mPa · s | 295 nm |
| Example 9 | 249 mPa · s | 292 nm | 258 mPa · s | 297 nm |
| Example 10 | 250 mPa · s | 295 nm | 256 mPa · s | 293 nm |
| Example 11 | 246 mPa · s | 290 nm | 251 mPa · s | 292 nm |
| Example 12 | 251 mPa · s | 286 nm | 264 mPa · s | 295 nm |
| Example 13 | 243 mPa · s | 288 nm | 252 mPa · s | 291 nm |
| Example 14 | 243 mPa · s | 291 nm | 255 mPa · s | 295 nm |
| Example 15 | 256 mPa · s | 293 nm | 262 mPa · s | 299 nm |
| Example 16 | 248 mPa · s | 284 nm | 250 mPa · s | 289 nm |
| Example 17 | 256 mPa · s | 286 nm | 257 mPa · s | 290 nm |
| Example 18 | 257 mPa · s | 291 nm | 259 mPa · s | 294 nm |
| Example 19 | 252 mPa · s | 288 nm | 255 mPa · s | 292 nm |
| Example 20 | 252 mPa · s | 282 nm | 272 mPa · s | 298 nm |

TABLE 4

| Comparative Example Number | 1 Day after preparation Viscosity | 1 Day after preparation Number-average particle diameter | 1 Month after preparation Viscosity | 1 Month after preparation Number-average particle diameter |
|---|---|---|---|---|
| Comparative Example 1 | 255 mPa · s | 283 nm | 308 mPa · s | 309 nm |
| Comparative Example 2 | 260 mPa · s | 280 nm | 406 mPa · s | 330 nm |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-149970, filed Jul. 23, 2014, which is hereby incorporated by reference herein in its entirety.

What is claimed is:

1. A method for producing an electrophotographic photosensitive member comprising an electrically conductive support, an undercoat layer on the support, and a photosensitive layer on the undercoat layer, the method comprising:

preparing a coating liquid for an undercoat layer, said coating liquid comprising a titanium oxide particle; a polyol resin; an isocyanate compound in which one of a structure represented by either formula (1) or formula (2) is bonded to an isocyanate group; a monohydric alcohol represented by formula (3); and an ether having a boiling point higher than a boiling point of the monohydric alcohol represented by the formula (3);

forming a coat of the coating liquid for an undercoat layer; and drying and curing the coat to form the undercoat layer:

(1)

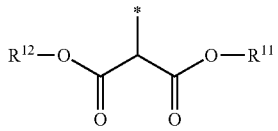

in the formula (1), $R^{11}$ and $R^{12}$ each independently represent an alkyl group having 1 to 4 carbon atoms, and * represents a bonding site capable of being bonded to the isocyanate group;

(2)

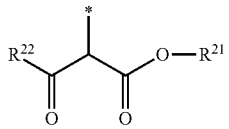

in the formula (2), $R^{21}$ and $R^{22}$ each independently represent an alkyl group having 1 to 4 carbon atoms, and * represents a bonding site capable of being bonded to the isocyanate group; and $$HO—R^3 \quad (3)$$

in the formula (3), $R^3$ represents an alkyl group having 1 to 4 carbon atoms.

2. A method for producing an electrophotographic photosensitive member according to claim 1, wherein the monohydric alcohol represented by the formula (3) is at least one member selected from the group consisting of methanol, ethanol, 1-propanol, and 1-butanol.

3. A method for producing an electrophotographic photosensitive member according to claim 1, wherein the isocyanate compound and the monohydric alcohol represented by the formula (3) satisfy one of the following formulae (4) and (5):

$$N^{11} \geq N^{12} \geq N^3 \quad (4)$$

$$N^{21} \geq N^3 \quad (5)$$

in the formula (4), $N^{11}$ represents the number of carbon atoms of $R^{11}$ in the formula (1), $N^{12}$ represents the number of carbon atoms of $R^{12}$ in the formula (1), and $N^3$ represents the number of carbon atoms of $R^3$ in the formula (3), and in the formula (5), $N^{21}$ represents the number of carbon atoms of $R^{21}$ in the formula (2) and $N^3$ represents the number of carbon atoms of $R^3$ in the formula (3).

4. A method for producing an electrophotographic photosensitive member according to claim 1, wherein the ether is at least one member selected from the group consisting of tetrahydropyran, tetrahydrofuran, and 1,3-dioxolane.

5. A method for producing an electrophotographic photosensitive member according to claim 1, wherein a ratio (Mm/Mu) of a mass (Mm) of the titanium oxide particle to a total mass (Mu) of the isocyanate compound and the polyol resin is 1/1 or more and 4/1 or less (mass ratio).

* * * * *